United States Patent [19]

Crowe et al.

[11] 4,063,630

[45] Dec. 20, 1977

[54] TYPEWRITER IMPACT POSITION ADJUSTMENT MECHANISM

[75] Inventors: William Ray Crowe; Thomas Michael Paulson, both of Lexington, Ky.

[73] Assignee: International Business Machines Corporation, Armonk, N.Y.

[21] Appl. No.: 699,909

[22] Filed: June 25, 1976

[51] Int. Cl.[2] ..... B41J 1/32

[52] U.S. Cl. ..... 197/53; 197/18; 197/60; 197/186 R

[58] Field of Search ..... 197/1 R, 18, 52–55, 197/149, 60, 186 R, 186 A

[56] References Cited

U.S. PATENT DOCUMENTS

| | | | |
|---|---|---|---|
| 2,178,682 | 11/1939 | Dobson | 197/149 |
| 3,384,216 | 5/1968 | Thayer | 197/53 |
| 3,400,798 | 9/1968 | Smith | 197/1 R |
| 3,759,359 | 9/1973 | Stellmach | 197/1 R |
| 3,830,352 | 8/1974 | Kolpek | 197/186 A |
| 3,921,787 | 11/1975 | Fujio et al. | 197/53 |
| 3,990,565 | 11/1976 | Felton et al. | 197/186 A X |

*Primary Examiner*—Edward M. Coven
*Attorney, Agent, or Firm*—John W. Girvin, Jr.

[57] ABSTRACT

A typewriter-printer includes a single element printing mechanism which is pivotable about the center line of the curved platen to an optimum print line viewing position. Printing can thus take place, for example, along a print line located below the center line of the curved platen or, in the alternative, above the platen center line in accordance with operator adjustment of the printing mechanism. The printing mechanism is mounted for printing motion and is further mounted for escapement motion with respect to the stationary platen.

8 Claims, 7 Drawing Figures

TYPEWRITER IMPACT POSITION ADJUSTMENT MECHANISM

Reference

U.S. Pat. No. 3,830,352, issued Aug. 20, 1974, filed Oct. 2, 1972, entitled "Articulated Typewriter Frame", assigned to International Business Machines Corporation.

BRIEF BACKGROUND OF THE INVENTION

1. Field

This invention relates to an improved typewriter mechanism, and more particularly, to an adjustable print mechanism to facilitate print line visibility.

2. Description of the Prior Art

Prior art typewriter devices have included print mechanisms which are moved from a rest position to a printing position. When the print mechanism is located at its rest position, away from the print receiving surface, the operator of the typewriter can readily view the line of print currently being printed (print line) since the print mechanism is generally located sufficiently far from the print receiving surface to prevent it from blocking the operator's view of the print line. Since the advent of the automatic typewriter, it has become desirable to increase the print out speed of the typewriter so that previously keyed information which has been captured on a secondary media such as magnetic tape, can be rapidly printed under operator control at a rate exceeding normal keyboarding rates. In order to increase the printout speed, it has been necessary to utilize single element printing mechanisms in contradistinction to individually mounted print elements such as typebars or the like so that characters may rapidly be selected without the individually mounted mechanisms interfering with one another. Further, it has been necessary to locate the printing element in close proximity to the print receiving platen to reduce the distance travelled by the print element and hence reduce the printing time. Location of the single element printing mechanism which includes a complete character set adjacent the print line generally interferes with the operator's view of the print line. The viewability problem is further complicated by the wide variety of viewing positions assumed by different machine operators.

Various prior art devices have been constructed to rotatably adjust the entire typewriting mechanism with respect to the operator's position to enhance operator viewability of the print line. An example of such a prior art device is described in the above referred to U.S. Pat. No. 3,830,352. There, the entire printer including the single element printing mechanism and the platen may be adjusted with respect to an assumed operator position. While such an arrangement provides a versatility of relationships between the operator position and the printer, it does not vary the location of the print line with respect to the curved platen on which the print receiving medium is located. Thus, as the entire printer is rotated in a first direction about its pivot, the print line becomes viewed at an acute angle wherein the character is viewed in a distorted fashion. As it is rotated in the second direction, the print element tends to block the print line viewability at the print point. Thus, while prior devices provide some degree of adjustment to facilitate different operator positions, they do so by adjusting the position of the entire printer and do not vary the location of the print line with respect to the print element.

SUMMARY

In order to overcome the above noted short-comings of the prior art and to provide a printer capable of printing at high speed and having a print line, the entirety of which can be readily viewed at a variety of viewing positions, the present invention provides an ajustment mechanism for varying the impact position of the print element as well as the location of the print element with respect to the curved platen which retains the print receiving medium. Accordingly, it is an object of the invention to vary the vertical position of a single element print mechanism relative to a curved print receiving platen to enhance operator viewability of the print line while retaining the print element rest position in close proximity to the platen. It is a further object of the invention to provide a print mechanism which can be adjusted to a low vertical position with respect to the platen to allow a short operator whose line of vision is more proximate to the horizontal to see over the print element and view the print line. Further, the print mechanism can be adjusted in an upward direction so that a tall operator can see over the print element thus viewing the print line with less distortion than if the print line were located at the short operator position. An additional object of the invention is to vary the vertical position of a print mechanism relative to a platen without changing the distance through which the print mechanism travels to impact the platen.

The foregoing and other features and advantages of this invention will be apparent from the following more particular description of the preferred embodiment of the invention as illustrated in the accompanying drawings.

IN THE DRAWINGS

FIG. *4a*, *4b*, and *4c*, are schematic illustrations of various positions which a print element may assume with respect to a curved document platen.

Figure 5:
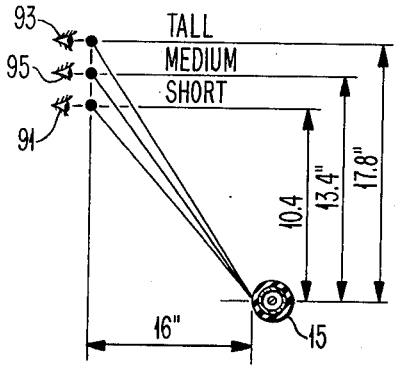

FIG. 5 is a schematic diagram of various operator viewing positions with respect to a platen.

DESCRIPTION

Figure 1:
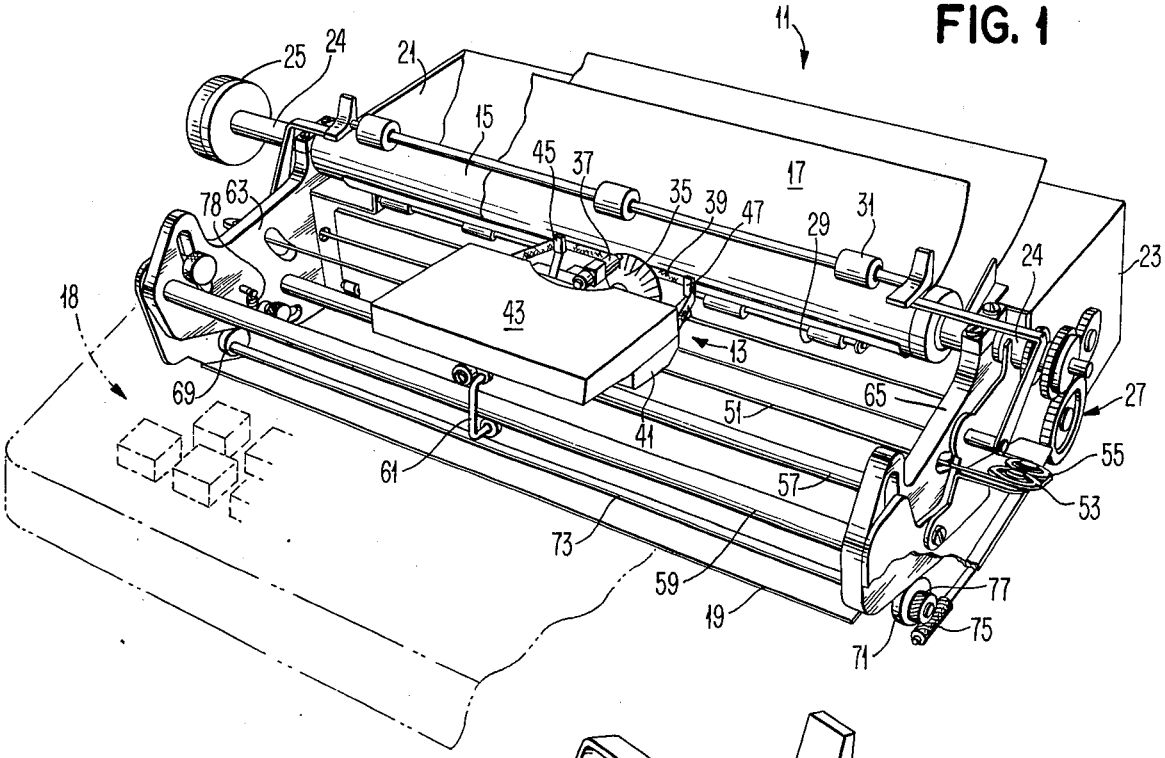
FIG. 1 is a perspective sketch of a typewriter printing mechanism and a print receiving platen including the position adjustment mechanism of the present invention.

Referring now to the drawings, and more particularly to FIG. 1 thereof, a perspective sketch of a typewriter printing mechanism and the print receiving platen including the position adjustment mechanism of the present invention is depicted. Typewriter II includes a printing mechanism 13 and a cylindrical platen 15 about which a print receiving medium such as a sheet of paper 17 may be wrapped to receive printing thereon from the printing mechanism. The typewriter 11 may also include a keyboard 18 which may be attached to the front portion of the frame 19. The frame 19 includes a bottom plate and side plates 21 and 23 secured thereto. The side plates 21 and 23 carry and support the platen shaft 24 which in turn supports the platen 15 for rotary motion about the center axis of the cylindrical platen and maintains the platen at a fixed vertical position. The platen may be rotated manually upon rotation of the platen knob 25 or automatically by a drive means (not shown) connected to gear train 27. Paper feed rolls 29 are located on the underside of the platen and are spring loaded thereagainst so that rotary motion of the platen advances the sheet 17. Conventional paper bails 31 cause the sheet 17 to follow the contour of the platen to further facilitate printing thereon.

The printing mechanism 13 comprises a print element 35, a print hammer 37 and a print ribbon 39, all of which are mounted to a print element carrier 41. The print element 35 includes a plurality of print spokes extending radially from a hub, each of the spokes carrying a type symbol or character thereon. Rotation of the print element effects proper character selection at a print point. Actuation of print hammer 37 causes the hammer to travel a fixed distance thusly driving the selected type symbol into ribbon 39 and thence into sheet 17 to thereby impact the sheet with the selected type symbol thereby creating a print image. The ribbon is fed from a cartridge 43 through ribbon guides 45 and 47 and back into the cartridge 43. The ribbon guides maintain the ribbon in a taut condition and further lift the ribbon to the print line position when impacting the sheet 17. The ribbon guides also lower the ribbon away from the print line to facilitate operator viewing of the print line.

As each character is printed, the print element carrier 41 is escaped to the next subsequent print position so that a line of printing may be serially created. Cable 51 is secured to the print carrier 41 and wound about pulleys 53, 55 and connected to a drive source (not shown) which effects displacement of the cable and hence the print element carrier in a printing direction or in a line return direction. The print element carrier is supported for escapement motion by two parellel support rails 57, 59. The print element carrier 41 includes a roller assembly 61 which cooperates with the support rail 59 and two similar roller assemblies (not shown) which cooperate with the support rail 57. The roller assemblies each have upper and lower rollers to prevent vertical motion of the print element carrier. The print mechanism including the print selection controls may be substantially similar to those of the Qume Q series printers, presently manufactured by Qume Corporation of Haywood, Calif.

In order to enhance operator viewability of the print line, the print element carrier of the present invention is adjustable so that the print element may be rotated about an axis concentric with the center of curvature of the platen. This adjustment of the print element carrier is effected by rotatably moving the support rails 57 and 59 which are connected to the print element carrier 41 through the roller assembly 61 and the roller assemblies (not shown).

Each of the support rails 57 and 59 are fixedly secured to rail carriers 63 and 65 at their respective ends. The rail carriers are in turn supported by the platen shaft 24 and by cams 69 and 71. Cams 69 and 71 are each mounted on shaft 73 which is rotated by worm 75 which acts on worm gear 77. Shaft 73 is secured to the side plates 21 and 23. Accordingly, rotation of the cams 69, 71 effects movement of the cam following surfaces of the rail carriers 63, 65 causing the rail carriers to rotate about the platen shaft 24. Spring 78 and a further spring (not shown) bias the cam following surfaces against their respective cams.

Figure 2:
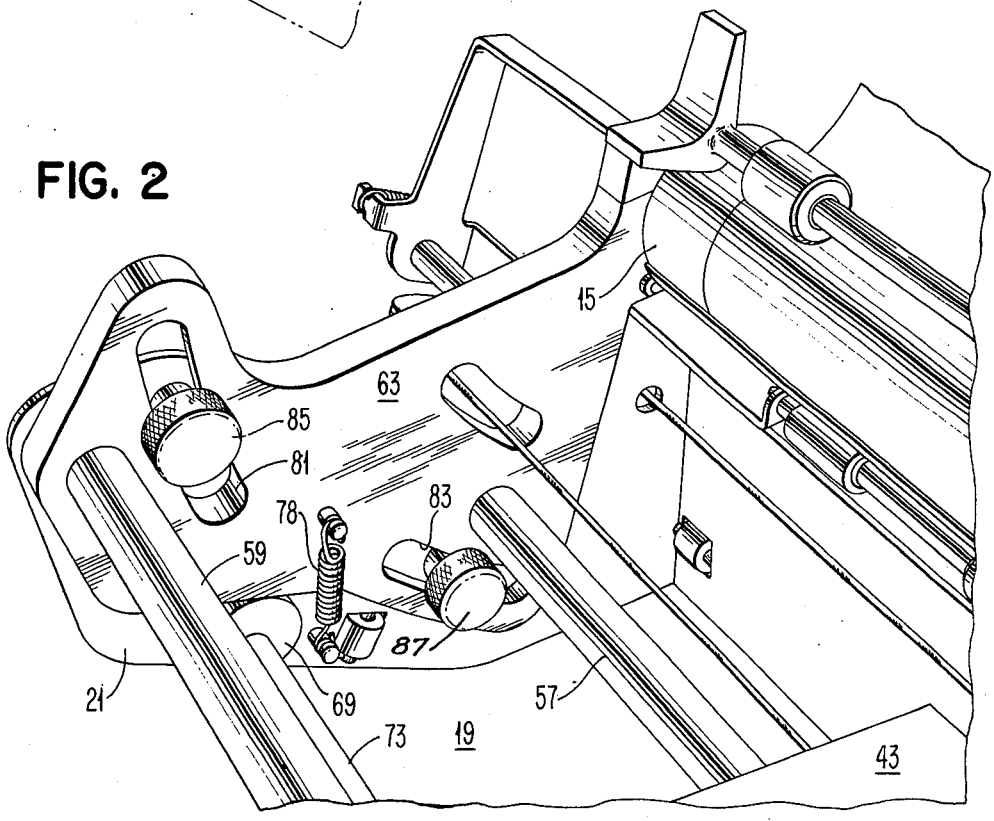
FIG. 2 is a detailed perspective drawing of the position adjustment mechanism of the present invention.

Referring now to FIG. 2 of the drawings, a detailed perspective drawing of the position adjustment mechanism of the present invention is depicted. As mentioned heretofore, rotation of the cam 69 which is mounted to side plate 21 the effects pivotal motion of the rail carrier 63 about an axis concentric to the center line of the cylindrical platen 15. Arcuate slots 81 and 83 are located in the rail carrier 63 and form a guide surface for pins 85, 87 which extend through the slots 81, 83 from the side plate 21 to which they are secured.

Figure 3:
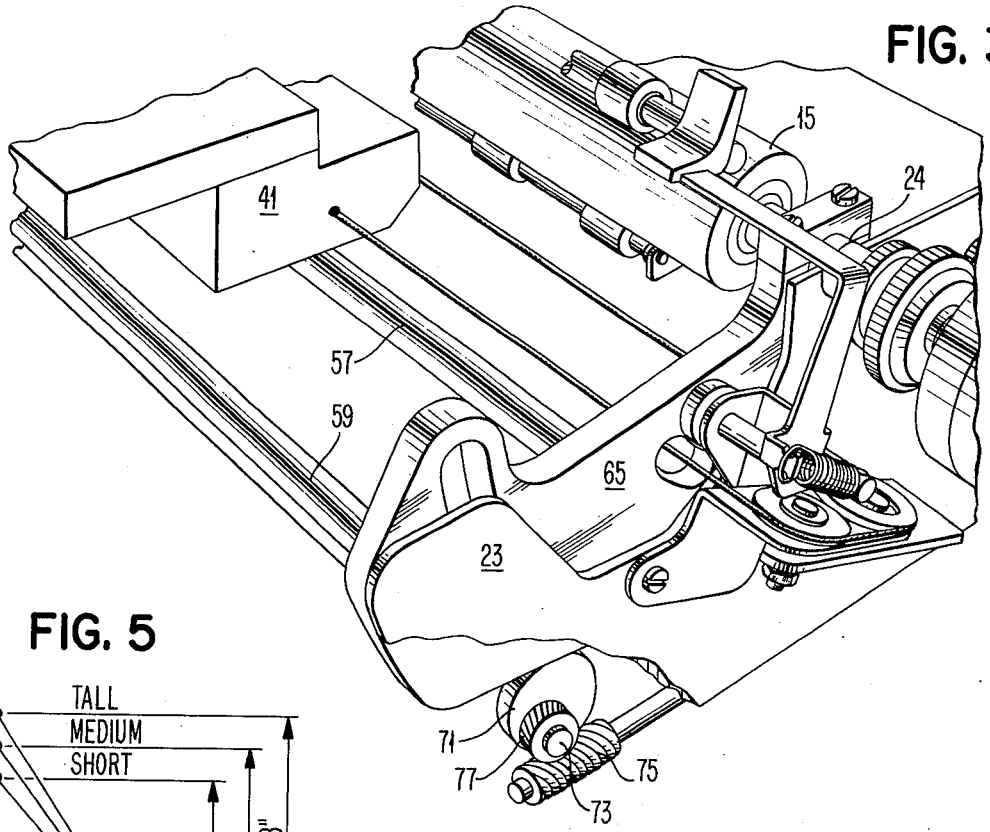
FIG. 3 is a further perspective view of the position adjustment mechanism of the present invention.

With reference to FIG. 3 of the drawings, a further perspective view of the position adjustment mechanism of the present invention is depicted. The rail carrier 65 pivots and the platen shaft 24 which is concentric with the platen 15 upon the rotation of cam 71. The platen shaft 24 is rotatabl supported by the frame 23 which further supports the shaft 73 on which the cam 71 is mounted. Thus, the rail carrier 65 rotates about a line approximate the center line of the platen 15 as cam 71 rotates. As the rail carrier 65 thusly rotates, it carries therewith the support rails 57 and 59 which in turn carry therewith the print element carrier 41. Accordingly, rotation of cam 71 effects rotation of the print element carrier 41 about an axis concentric with the center line of the platen 15.

Figure 4A:
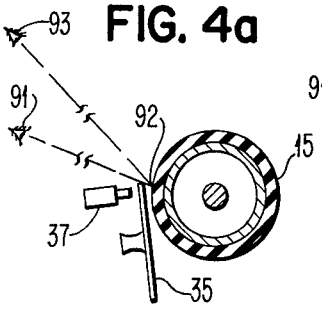
Figure 4B:
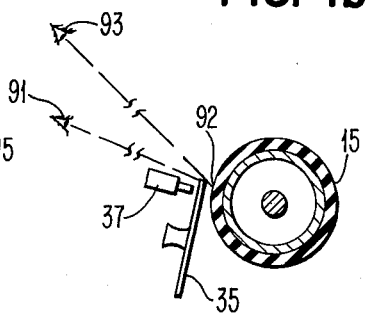
Figure 4C:
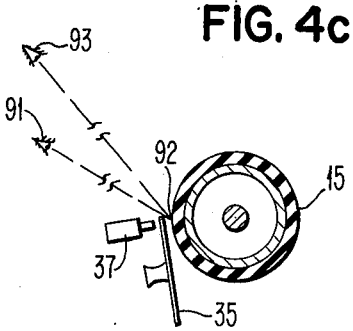

FIGS. 4a–4c are schematic illustrations of various positions which the print element may assume with respect to a curved document platen.

FIG. 4a represents an intermediate adjustment position while FIG. 4b represents the position to which a tall operator would adjust the print element while FIG. 4c represents the position to which a short operator would adjust the print element. With reference first to FIG. 4b, depicting the tall operator position, it can be seen that the short operator viewing position 91 provides an inadequate line of sight to the print line 92 since the line of sight is blocked by the print element 35. However, the line of sight between the tall operator viewing position 93 and the print line 92 is not blocked thereby enabling the tall operator to see over the print element 35 and clearly view the print line. It is to be noted that the print line is located above the horizontal center line of the platen, the print line thusly being more normal to the operators line of sight than if located below the horizontal center line of the platen.

With reference to FIG. 4c, the print element 35 has been adjusted to a position to facilitate the viewing of the print line by a short operator. Thus, the short operator viewing the print line 92 from the short operator viewing position 91 can see over the print element 35 and view the print line. Although the tall operator viewing the print line from the tall operator viewing position 93 can also see over the print element 35 and view the print line, the print line as thusly viewed is somewhat distorted due to the acute angle at which it is viewed. That is, the print line 92 is located below the horizontal center line of the platen and is viewed from the tall operator viewing position 93 at an acute angle thereby causing the characters to appear distorted at this viewing position. Thus, the optimum viewing position for the tall operator is depicted in FIG. 4b. FIG. 4a represents an intermediate viewing position for a medium height viewing position located between positions 91 and 93. In FIG. 4b, the print element 35 has been rotated in a clockwise direction by approximately 10° from the position depicted in FIG. 4a while FIG. 4c represents a 10° couterclockwise movement from the position of FIG. 4a.

Referring now to FIG. 5 of the drawings, a schematic diagram of various operator viewing positions with respect to a platen is depicted. It has been found that 90% of typewriter operators assume a viewing position horizontally displaced from the platen by 16 inches or less. The vertical displacement of the viewing position is determined by physical height of the operator and the relationship of the stand on which the typewriter is placed with respect to the chair on which the operator is seated. The distances shown in FIG. 5 correspond to the tall and short operator positions discussed with respect to FIG. 4.

Referring once again to FIG. 1 of the drawings, it has been described how the print element carrier 41 is rotated about a line concentric with the center line of the platen 15. This rotation is effected upon operator initiated rotation of cams 69 and 71 which act on the cam follower surfaces of rail carriers 63 and 65 respectively thereby causing the rail carrier to rotate about the platen shaft 24. Support rails 57 and 59 are fixedly secured to the rail carriers and rotate therewith thereby effecting simultaneous rotation of the print element carrier 41 about the platen 15. Rotation of the print element carrier effects corresponding rotation of the print mechanism including the print element 35, thereby vertically displacing the print impact point with respect to the sheet 17 located on the platen 15. Movement of the print point and hence the print line in a vertically upward direction enhances the viewability of the print line from a tall operator position. Rotation of the print element 35 in a vertically downward direction enhances viewability of the print line from a short operator position since the print element 35 is rotated from a blocking relationship with the operator's line of view.

Once the print carrier including the print element 35 has been properly positioned for printing, the operator may thereafter initiate printing through the utilization of a conventional keyboard 18 connected to the printer or by causing characters recorded on a secondary medium to effect printing through a conventional media reader and printer interface (not shown) such as those employed with the IBM Magnetic Card "Selectric" typewriter.

In either event, print wheel 35 is rotated until the selected character is located adjacent the printing location at which time hammer 37 is fired causing the selected print element to impact the sheet 17 through ribbon 39 thereby effecting printing. Once a character has thusly been printed, the print element carrier 41 is escaped over the support rails 57, 59 to the next subsequent printing position and the operation is repeated until an entire print line has been created. At this time, the platen is indexed or moved in a rotational direction thereby effecting vertical movement of the sheet 17 with respect to the print element 35 so that the next line of printing can take place. It is to be noted that since the print mechanism pivots about the platen, the distance which the print element and hammer travel to effect print impact remains constant thereby eliminating further complex adjustment of the print mechanisms to compensate for varying distances of travel and resulting impact force variations.

While the invention has been described with respect to an adjustment mechanism which effects movement of the print element with respect to a stationary platen, it is recognized that the platen could be moved relative to a stationary print element or simultaneous relative motion could be effected to achieve similar results. Further, it is understood that rotation of the cams 69 and 71 can be under the manual control of an operator through a manually rotatable knob or under the automatic control of an operator upon selective actuation of a reversable motor or the like. In either event, a pawl and ratchet may be utilized to detent the adjustment mechanism and thus keep it at the adjusted position. Additionally, the invention may be practiced with other forms of curved platens other than a cylindrical roll type described, it only being necessary to insure the constant distance between the print mechanism and the platen by pivoting the print mechanism relative to the platen about an axis proximate the center of curvature of the platen.

While the invention has been particularly shown and described with reference to the preferred embodiment thereof, it will be understood by those skilled in the art that the foregoing and other changes in form and detail may be made therein without departing from the spirit and scope of the invention.

What is claimed is:

1. A printer for forming images upon a document sheet and including print line visibility enhancement means comprising:

a print element having at least one type symbol thereon for traveling over a path a fixed distance and for impacting the sheet with the type symbol at a given angle of strike between the sheet and path of travel;

a platen having a curved platen surface for retaining the sheet thereon while said sheet and platen surface are impacted by the type symbol, said curved platen surface having a center of curvature;

a platen carrier means for maintaining the platen at a constant vertical position;

a print element carrier means for maintaining the print element at a vertical position;

print line visibility enhancement adjustment means connected to said print element carrier means for independently adjusting the relative vertical position of the print element with respect to the platen about an axis proximate to the center of curvature of the curved platen surface, to thereby maintain approximately the same distance of travel and angle of strike of said type symbol on said platen surface, said platen being maintained at said constant vertical position at least during said relative vertical position adjustment, said type symbol impacting said sheet and platen surface at different vertical positions of said sheet and platen surface depending upon the adjusted relative position.

2. The printer set forth in claim 1 wherein said print line visibility enhancement adjustment means is pivotally mounted to said platen carrier means and connected to said print element carrier means for pivoting said print element carrier means about an axis proximate the center of curvature of said platen surface.

3. The printer set forth in claim 2 wherein said print element comprises a slotted print disc having a plurality of print spokes, a selected one of which is rotatably positioned to a print position and wherein said printer further includes a print hammer for impacting the selected print spoke to cause said spoke to travel said fixed distance to create an image of said type symbol at a vertical position on the document sheet dependent upon the position of said print line visibility enhancement adjustment means.

4. The printer set forth in claim 3 wherein said print line visibility enhancement adjustment means includes a cam surface and a cam follower connected to the print element carrier means, the position of the cam surface with respect to the cam follower surface being settable by operator control and controlling the position of the print element carrier means with respect to said platen.

5. The printer set forth in claim 2 wherein said print line visibility enhancement adjustment means includes a cam surface and a cam follower connected to the print element carrier means, the position of the cam surface with respect to the cam follower surface being settable by operator control and controlling the position of the print element carrier means with respect to said platen.

6. The printer set forth in claim 1 wherein said print element carrier means is mounted for escapement on at least one guide surface located parallel to the axis of the center of curvature of the platen surface and wherein said print line visibility enhancement adjustment means is pivotably mounted to said platen carrier means and connected to said guide surface for pivoting said guide surface and said print element carrier means about an axis proximate the center of curvature of said platen surface.

7. The printer set forth in claim 6 wherein said print element comprises a slotted print disc having a plurality of print spokes, a selected one of which is rotatably positioned to a print position and wherein said printer further includes a print hammer for impacting the selected print spoke to create an image of said type symbol at a vertical position on the document sheet dependent upon the position of said print line visibility enhancement adjustment means.

8. The printer set forth in claim 6 wherein said print line visibility enhancement adjustment means includes a cam surface and a cam follower connected to the print element carrier means, the position of the cam surface with respect to the cam follower surface being settable by operator control and controlling the position of the print element carrier means with respect to said platen.

* * * * *